US005141199A

United States Patent [19]

Nemeth

[11] Patent Number: 5,141,199

[45] Date of Patent: Aug. 25, 1992

[54] COPYSTAND WITH STORAGE AREA FOR MAGNETIC MEDIA

[75] Inventor: Bradley M. Nemeth, San Francisco, Calif.

[73] Assignee: Brauner-Nemeth, Inc., Palo Alto, Calif.

[21] Appl. No.: 740,776

[22] Filed: Aug. 6, 1991

[51] Int. Cl.[5] ..... A47G 1/24

[52] U.S. Cl. ..... 248/455; 248/463

[58] Field of Search ..... 248/441.1, 460, 454, 248/455, 456, 457, 447, 452, 463, 465, 464; 281/45

[56] References Cited

U.S. PATENT DOCUMENTS

| | | | |
|---|---|---|---|
| 2,003,746 | 6/1935 | Headington | 248/456 X |
| 4,044,980 | 8/1977 | Cummins | 248/456 X |
| 4,518,140 | 5/1985 | Ferranto | 248/456 |
| 4,555,128 | 11/1985 | White | 281/45 |
| 4,735,394 | 4/1988 | Facco | 248/456 X |
| 4,798,015 | 1/1989 | Ackeret | 248/455 X |

FOREIGN PATENT DOCUMENTS

| | | | |
|---|---|---|---|
| 221031 | 5/1942 | Switzerland | 248/455 |
| 2150427 | 7/1985 | United Kingdom | 248/441.1 |

*Primary Examiner*—J. Franklin Foss

*Attorney, Agent, or Firm*—Townsend and Townsend

[57] ABSTRACT

A copystand for holding magnetic disks and documents is disclosed. In an open position, disks can be inserted into and removed from the base means while a document is held in proper reading position by the copystand's face. In a closed position, the disks are locked into the base means and the now nearly flat copystand can be easily moved to another location. If desired, documents may remain attached to the face of the copystand during such a move.

11 Claims, 5 Drawing Sheets

COPYSTAND WITH STORAGE AREA FOR MAGNETIC MEDIA

BACKGROUND OF THE INVENTION

This invention relates to office equipment. In particular, it is a copystand for use with computer workstations.

Copystands are known. Indeed, it is probable that Egyptian scribes had some type of copystand available to them as they transcribed material from one sheet of papyrus to another. In their most common modern embodiment, copystands are easel-like devices with clips or magnets for holding the text being copied against the stand. Such stands are frequently made from metal (although plastic copy stands are not unknown) and serve their purpose reasonably well.

However, this technology, which originated in dynastic Egypt and was refined in medieval monasteries, is not fully adapted to the modern, computerized office. Frequently, documents are created on a computer, stored on magnetic media such as magnetic disks, and edited by accessing the document from the magnetic media. For purposes of this application, the magnetic media will be assumed to be 3½" diskettes, herein called disks. Although many people still prefer to edit a printed copy of the document, it is becoming more and more common for a document to be printed only once, after all editing has been completed on computers, using the version of document stored on the disk.

In modern offices, it is also not uncommon for a document to be created on one computer, edited on a second, and printed using a third. Each move requires the exchange of the disk on which the document is stored. At some point, if a draft copy of the document is printed and edited, a computer operator will need to read from the edited copy while effecting the changes on the disk storing the document. This movement of documents and disks can result in the separation of disks from their associated printed document, causing a certain amount of confusion and lost time as a search for the missing item(s) is conducted.

Given this possible confusion, a need exists for a system which will hold and store disks and their related printed documents together, so that the disks will not be easily damaged and will not become separated from the related documents. It will also be helpful if this system did not multiply the number of things requiring space on a computer operator's desk or work area.

SUMMARY OF THE INVENTION

The present invention comprises a copystand for holding printed material in an easy-to-read upright position. The copystand's base has several disk storage areas, which hold the disk(s) containing the document, which document is being read/edited on the stand. To edit the document, the computer operator removes the disk from the copystand's storage area and inserts the disk into a computer, whereupon the changes indicated on the printed copy can be made on the disk. After the changes are complete, the amended disk is then returned to its storage place in the copystand.

If the document is later edited by someone else, the copystand can be collapsed, which locks the disks in place in their storage areas. If desired, the document can remain clipped to the copystand's face. The stand is then transported to the next operator/editor. By maintaining the disk(s) and document in a secure relationship, the confusion caused when one or the other is misplaced is avoided. Also, as copystands are already in common use, no extra equipment is needed, reducing desk clutter.

The copystand will now be described in detail with reference to the figures listed and described below.

DESCRIPTION OF THE SPECIFIC EMBODIMENT(S)

Figure 1:
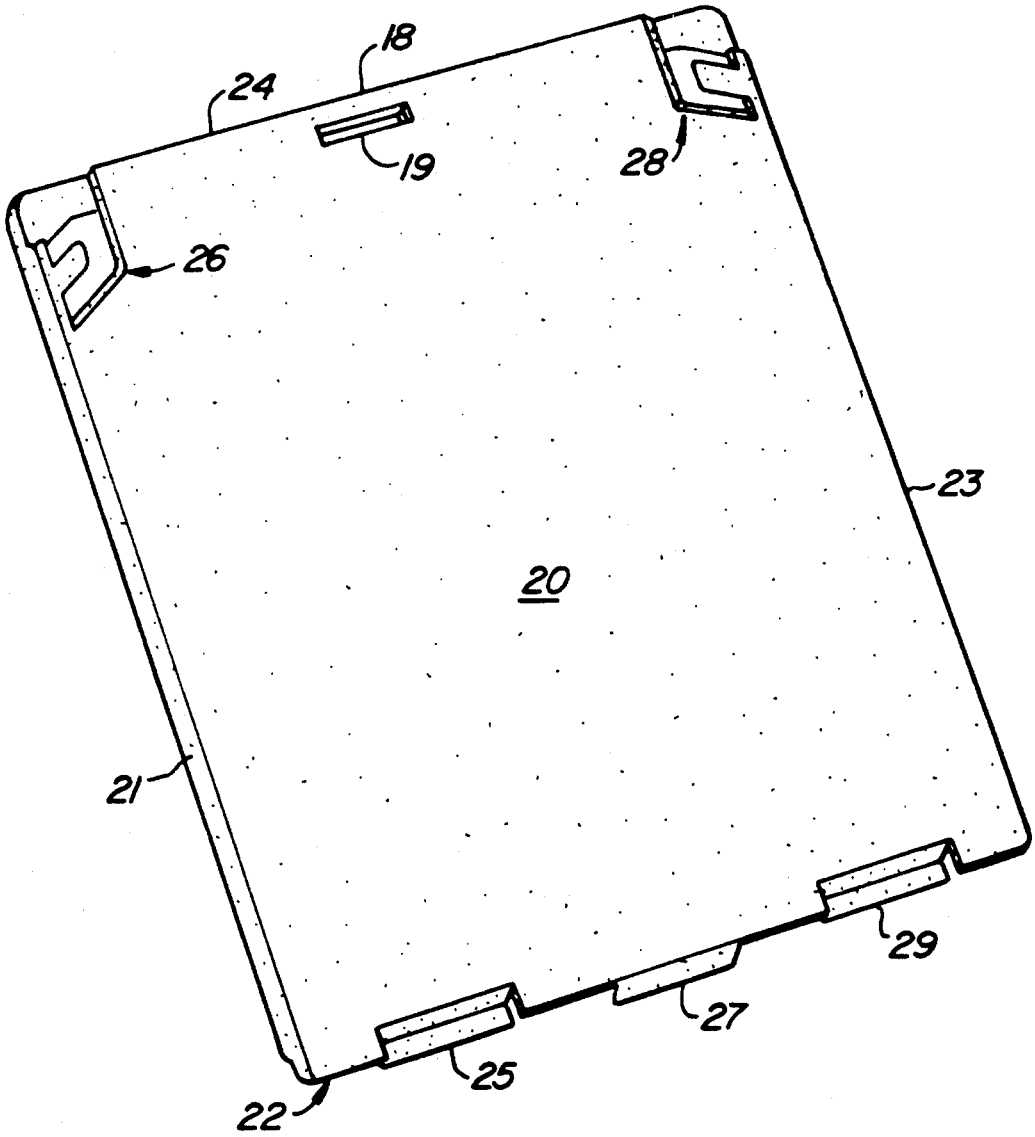
FIG. 1 illustrates the face of the present invention.

Face 20 of copystand 10 is shown in FIG. 1. Face 20 is generally flat with at least two side edges 21 and 23 along the lengthwise axis of face 20. Along bottom edge 22 of face 20, half-hinges 25, 27 and 29 are located. These interact with similar half-hinges 35, 37 and 39 in base 30 to allow the copystand to fold. Along top edge 24, two clips 26 and 28 are formed. These clips can hold anywhere from one to many sheets of paper at a given time. Additionally, the cardboard backing from a pad of paper can be slipped behind clips 26 and 28, which then hold the pad firmly. The pages of the pad rest over the clips. In the center of face 20, a small hole 19 is formed, which receives a projection 52 at the end of leg 50, forming a pivoting joint. Finally, a short edge 18 runs along the backside of top edge 24.

Figure 2:
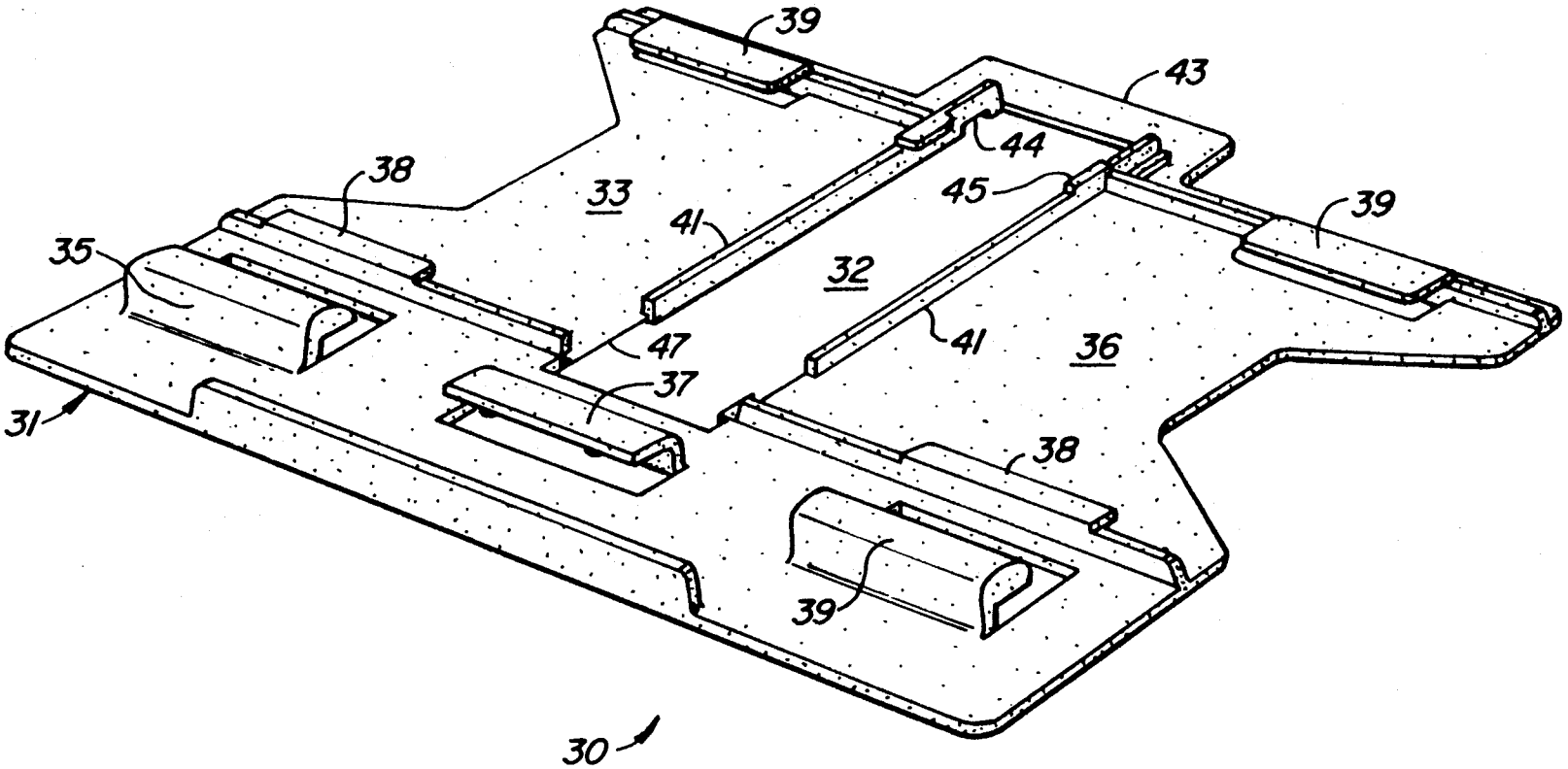
FIG. 2 illustrates the base of the present invention.

Base 30 is shown in FIG. 2. Along front edge 31 of base 30, half-hinges 35, 37 and 39 are formed. These half-hinges interact with half-hinges 25, 27 and 29 in face 20 to allow base 30 and face 20 to fold into one another. Disk storage areas 33 and 36 are formed on two sides of base 30. Each is comprised of a pair of side-guide slots 38 and 39 and a backstop 41. Backstops 41 prevent disks from being pushed too far into the storage areas, which might interfere with closing the copystand. Along the center of base 30, leg storage area 32 is defined. Backstops 41 form the sides of leg storage area 32. Near back edge 43 of base 30, backstops 41 have small areas 44 and 45 drilled out to receive mounting pins 54 and 55 in leg 50. Barbs 57 on leg 50 cooperate with notch 47 in backstops 41 to hold the stand closed.

Figure 3:
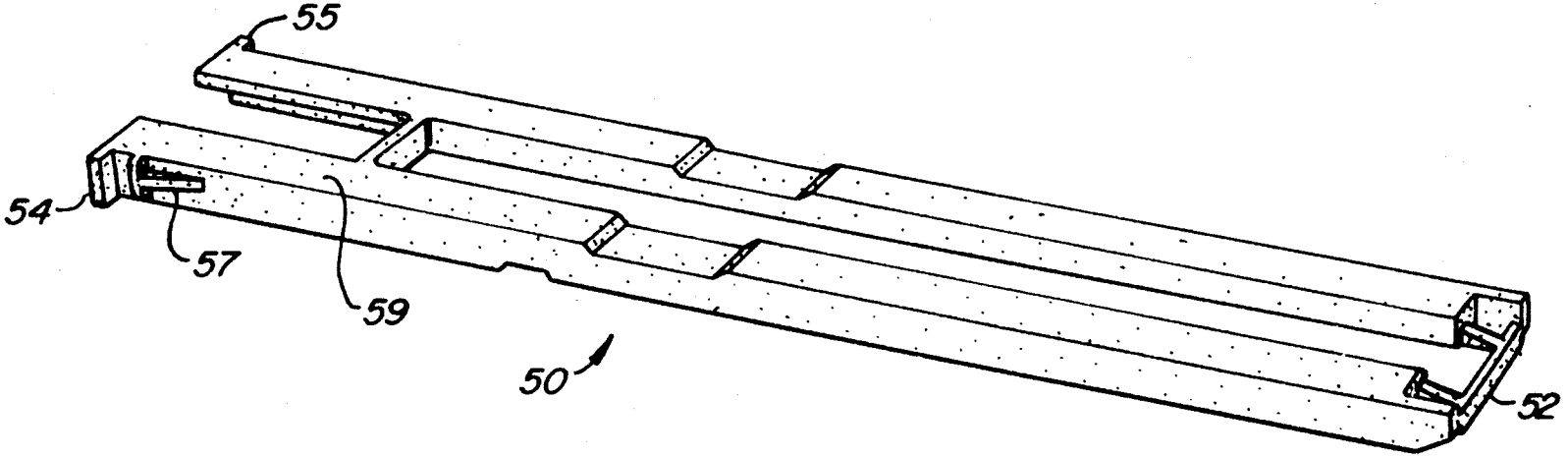
FIG. 3 illustrates the leg of the present invention.

Leg 50, as shown in FIG. 3, has a projection 52 at one end which fits into and remains in hole 19 in face 20. At the other end of leg 50, mounting pins 54 and 55 are formed. These extend into holes 44 and 45 in base 30 when leg 50 is in its raised position, holding the stand open. Immediately above pins 54 and 55 are barbs 57 which cooperate with backstops 41 of leg storage area 32 to hold the stand open and with notch 47 to hold the stand closed.

Figure 4A:
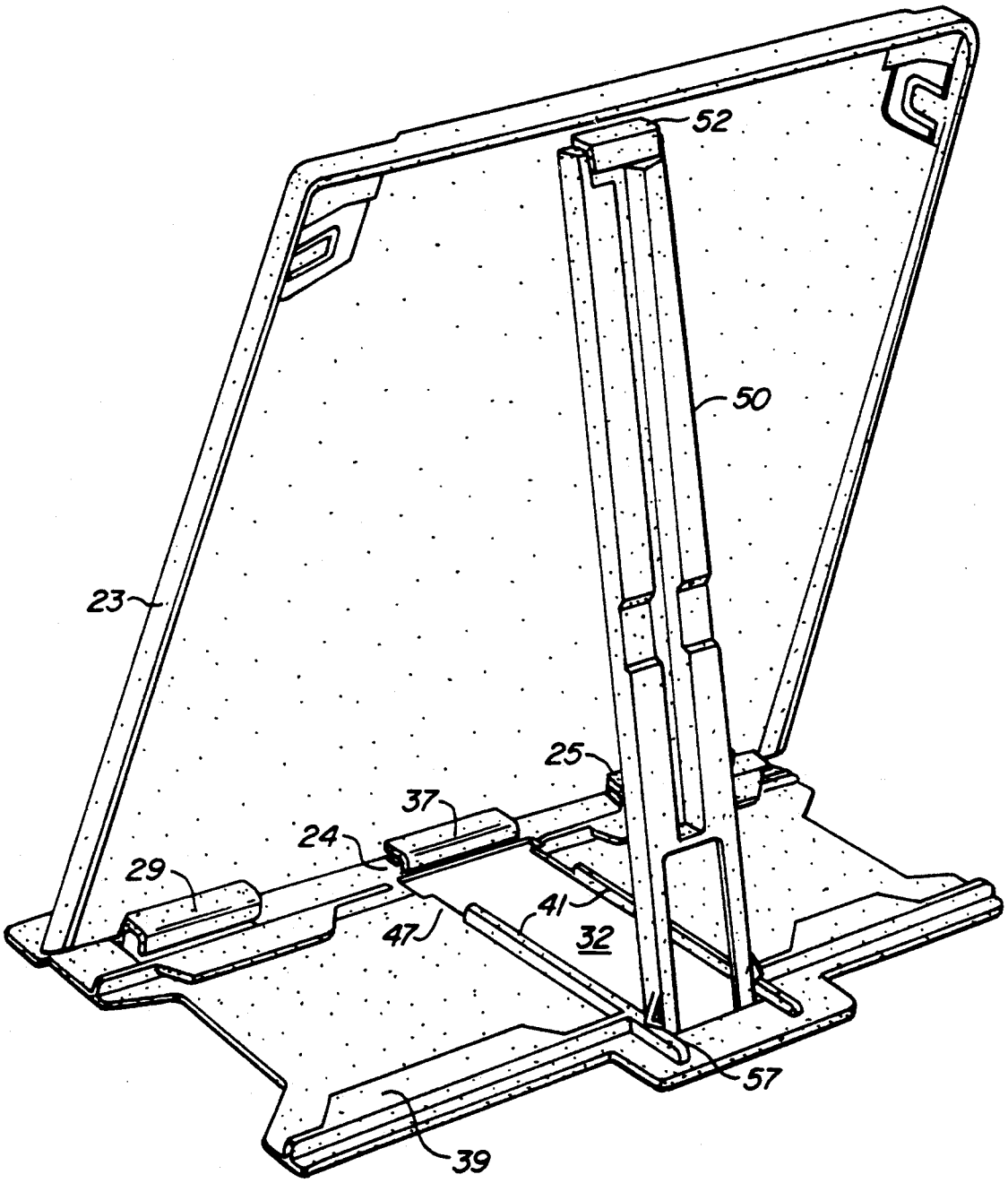
FIG. 4*a* and *b* represent the present invention in its open and closed position, respectively.
Figure 4B:
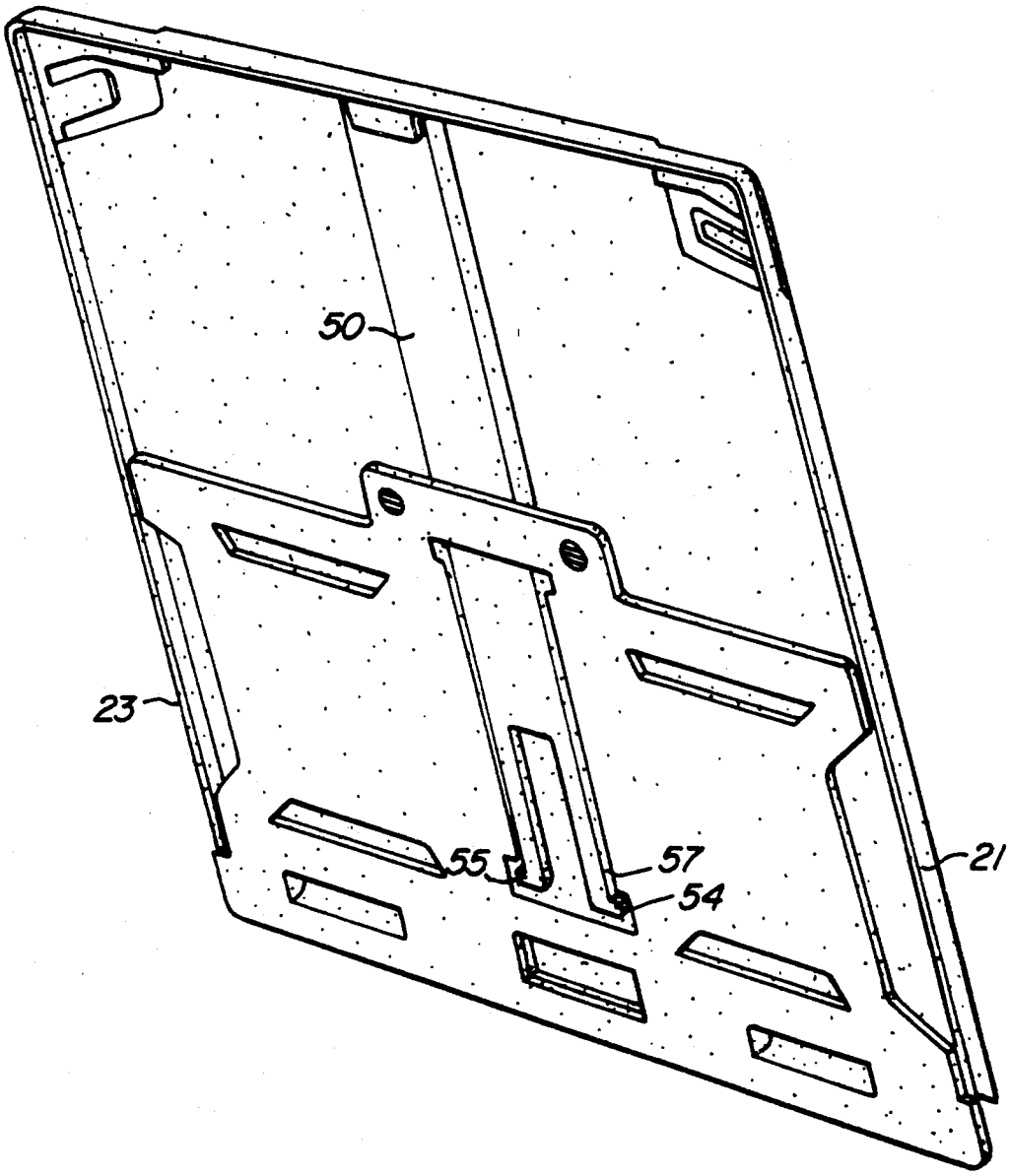

The open and closed positions of copystand 10 are shown in FIG. 4*a* and 4*b*, respectively. In its open position, leg 50 pivots about projection 52 within hole 19 and pins 54 and 55 are inserted into holes 44 and 45 in base 30, thereby propping face 20 open. Barbs 57 lock onto backstops 41 above holes 44 and 45 to help lock the stand open. Disks can be inserted and removed from disk storage areas 33 and 36 without obstruction. In the closed position shown in FIG. 4*b*, edges 21 and 23 of face 20 prevent disks from sliding out from areas 33 and 36, and leg 50 folds flat into leg storage area 32, after barbs 57 are released from the backstops above holes 44 and 45 and pins 54 and 55 are removed from holes 44 and 45. Closure is effected along the hinge line formed from half-hinges 35, 37, 39, 25, 27, and 29. Documents can remain clipped to face 20 when the copystand is in either the open or closed positions. In the closed position, barbs 57 interlock with notch 47 to hold the copystand closed.

It is understood that the above description is intended to be illustrative and not restrictive. For example, different sized disks could be stored in the storage areas. Indeed, one area could hold a disk of one size and the other area could hold a different size disk. Cassette tapes could also be stored, if the copystand was modified slightly. The stand can be made of any non-ferrous metal, although high impact styrene was used for one proposed embodiment. Many such variations of the invention will become apparent to those of skill in the art upon review of this disclosure. The scope of the invention should, therefore, be determined not with reference to the above description, but instead should be determined with reference to the appended claims along with their full scope of equivalents.

What is claimed is:

1. A copystand comprising:

base means;

prop means; and face means, the base means further comprising at least one magnetic media storage area, and a prop means storage area defining at least one side of said magnetic media storage area, the face means having at least one document holding means.

2. The copystand of claim 1 wherein the magnetic media storage area can store a magnetic disk.

3. A copystand for holding documents and magnetic storage media, the copystand having at least a first open position and a second closed position, the copystand comprising:

base means comprising a plurality of magnetic media storage areas, a prop means storage area, and a plurality of first half-hinges;

face means comprising at least one document holding means, a plurality of second half-hinges which interact with the first half-hinges allowing the copystand to open to the first open position and to close to the second closed position, locking means which interacts with the base means to hold the copystand in its second closed position; and prop means pivotally mounted in the face means, the prop means laying in the prop means storage area when the copystand is in its second position and bracing against the base means to hold the copystand in its first position when the copystand is in the open position.

4. The copystand of claim 3 wherein the magnetic media storage areas comprise magnetic disk storage areas.

5. A copystand for holding documents and magnetic storage media, the copystand having at least a first open position and a second closed position, the copystand comprising:

base means having at least one magnetic media storage area;

prop means; and face means, the face means having one or more side edges extending perpendicular to said face means toward said base means, said one or more side edges defining at least one side of said magnetic media storage area when the copystand is in said second closed position.

6. A copystand as recited in claim 5 wherein said base means includes a prop means storage area.

7. A copystand as recited in claim 6 wherein said prop means storage areas defines at least one side of said magnetic media storage area.

8. A copystand as recited in claim 5 wherein the magnetic media storage area is sized to store a magnetic disk.

9. A copystand as recited in claim 5 wherein a magnetic medium held within the magnetic media storage area can be slidable removed from the magnetic media storage area when the copystand is in the first open position.

10. A copystand as recited in claim 5 wherein a magnetic medium held within the magnetic media storage area is prevented from leaving the magnetic media storage area when the copystand is in the second closed position.

11. A copystand as recited in claim 1 wherein the base means includes two magnetic media storage areas.

* * * * *